United States Patent [19]

Seidel et al.

[11] Patent Number: 5,033,484

[45] Date of Patent: Jul. 23, 1991

[54] VENTILATED FILTER CIGARETTE

[75] Inventors: Henning Seidel, Mechtersen; Edgar Mentzel, Quickborn; Reza Nasseri, Glinde, all of Fed. Rep. of Germany

[73] Assignee: H.F. & Ph.F. Reemtsma GmbH & Co., Hamburg, Fed. Rep. of Germany

[21] Appl. No.: 433,380

[22] Filed: Nov. 8, 1989

[30] Foreign Application Priority Data

Nov. 9, 1988 [DE] Fed. Rep. of Germany ..... 3837930

[51] Int. Cl.[5] ..... A24B 1/00

[52] U.S. Cl. ..... 131/364; 131/345; 131/360; 131/365

[58] Field of Search ..... 131/365, 364, 345, 360

[56] References Cited

U.S. PATENT DOCUMENTS 4,878,507 11/1989 Case et al. ..... 131/364

OTHER PUBLICATIONS

*Tobacco and Tobacco Smoke,* by Wynder et al., Academic Press, N.Y., U.S.A., N.Y., 1967 published.

*Composition Studies in Tobacco XXXVI,* pp. 71–73, by Lakritz et al., Eastern Utilization Research and Development Division, Agricultural Service, U.S.D.A., Philadelphia, Pa. U.S.A.

*Primary Examiner*—V. Millin

*Attorney, Agent, or Firm*—Pravel, Gambrell, Hewitt, Kimball & Krieger

[57] ABSTRACT

The ventilated filter cigarettes of the present invention have an American-blend flavor. The cigarettes comprise Virginia tobacco with main stream smoke have a condensate/nicotine ratio of 5:1 to 9:1, a condensate value of 10 mg maximum, a pH-value greater than 6.0, and a pollutant index of less than 35. Specific features of this invention include: a filling tobacco comprising Virginia tobacco with a high nicotine content of 2 to 3.5% by weight; a packing density is 150 to 250 mg/cm$^3$; a cigarette paper having an air permeability of 3 to 20 CORESTA units, in which the cigarette rod is in the hardness/haptic range of 1.9 to 2.5 mm ET; a fine-titre cellulose acetate filter having no flavor-modifying additives and having an individual titre of 1.3 to 2.5 denier, and a total titre of 40,000 to 55,000 denier resulting in a draw resistance of 95 to 160 daPa for a length of 21 mm and a diameter of 7.8 mm, and a secondary air supply corresponding to a filter ventilation level to 20 to 45%; and a final draw resistance of the cigarette of 100 to 160 daPa.

17 Claims, No Drawings

VENTILATED FILTER CIGARETTE

FIELD OF THE INVENTION

The invention relates to a ventilated filter cigarette with a prevailing American-Blend taste comprising Virginia-type tobacco more particularly, this invention relates to a vented filter cigarette having an American-blend taste whose main stream smoke exhibits a condensate/nicotine ratio of 5:1 to 9:1, a condensate value (according to DIN 10240) of 10 mg maximum, a pH-value above 6.0 and a harmful substance or pollutant index of less than 35 Herzfeld units.

BACKGROUND OF THE INVENTION

Certain consumer circles prefer cigarettes with the typical American-Blend flavor. However, the Burley tobacco used to obtain this flavor has a high protein content, which causes these cigarettes to have several undesirable qualities including an undesirable aroma and a very high nitrate content. The high nitrate content leads to a relatively high harmful substance or pollutant index.

It is possible to blend Virginia tobacco types with Burley tobacco types to obtain the desired American-blend flavor. Alternatively, the desired flavor may be obtained by adding non-tobacco additives to the cigarettes. The additives are limited by tobacco regulations. In addition, the incomplete burning or pyrolysis of the non-tobacco additives can lead to the formation of undesired pollutants, resulting in a higher pollutant index.

It is possible to obtain a thinning of main stream cigarette smoke through the use of a high ventilation filter. This thinning gives the cigarette a low condensate and nicotine value and a low pollutant index. However, the cigarette suffers from the disadvantage of a low tobacco flavor, an aroma deficit, and a low saturation level and therefore only has limited consumer acceptance.

Special filter constructions and particularly those with chamber filters intended to improve the flavor characteristics and provide a more favorable nicotine/-condensate ratio e.g., (8 mg of maximum condensate) are disclosed in European Patent Application EU-A 0 255 114. In addition, ventilated monofilter cigarettes are disclosed in German Patent Application DE-OS 30 11 959 which have specially designed, grooved filters. These grooved filters result in a rushing movement of the main stream smoke out of the filter body. Such cigarettes have more aroma, accompanied by lower nicotine and condensate values. However, these constructionally complicated filters reduce the cigarette's flavor.

In cigarettes known to date, the flavor type of the existing tobacco blend naturally reoccurs in a more or less reduced form in the main stream smoke and has never been changed into another flavor type.

A ventilated filter cigarette having low condensate values and in particular a low pollutant index, without having the known disadvantages, such as low tobacco flavor, aroma deficiency, low degree of saturation and therefore poor consumer acceptance is highly desirable. The present invention provides a ventilated cigarette having these desired characteristics.

SUMMARY OF THE INVENTION

A ventilated filter cigarette is proposed, which is characterized by a filling tobacco comprising Virginia tobacco with a high nicotine content of 2 to 3.5% by weight; a packing density is 150 to 250 mg/cm$^3$; a cigarette paper having an air permeability of 3 to 20 CORESTA units, in which the cigarette rod is in the hardness/haptic range of 1.9 to 2.5 mm ET; a fine-titre cellulose acetate filter having no flavor-modifying additives and having an individual titre of 1.3 to 2.5 denier, a total titre of 40,000 to 55,000 denier resulting in a draw resistance of 95 to 160 daPa for a length of 21 mm and a diameter of 7.8 mm, and a secondary air supply corresponds to a filter ventilation level of 20 to 45%; and a final draw resistance of the cigarette of 100 to 160 daPa.

A ventilated filter cigarette with a prevailing American-Blend taste is produced having condensate/nicotine values and pollutant values completely atypical for this flavor. A partial (up to 75%) volume-activated tobacco blend with a correspondingly adapted strand configuration and packing density is used with an inexpensive filter having a high draw resistance, preferably a monoacetate filter having a high retention capacity. The high draw resistance in combination with the high quality natural Virginia tobaccos even with relatively low filter ventilation result in a cigarette with a low pollutant index and a high degree of saturation. In a completely unexpected manner, the cigarette of the present invention has an intense American-blend or taste despite exclusive use of Virginia tobaccos.

DETAILED DESCRIPTION OF THE INVENTION

The following remarks are made on the individual parameters and/or features of the ventilated filter cigarette of the invention.

The nicotine content of natural Virginia tobacco influences the flavor or "strength" of a cigarette. In conventional cigarettes, the nicotine content is in the range of 1.7 to 2.3%, based on dry weight. The cigarette of the invention, intentionally possesses a high to unusually high nicotine content of 2 to 3.5%.

The packing density of the filling tobacco of standard commercial cigarettes is between 220 and 280 mg/cm$^3$. This density corresponds to a cigarette hardness range of approximately 1.9 to 2.5 mm ET (test punch penetration depth) as determined by the Reemtsma Hardness Measuring Instrument, which corresponds to the digital densimeter DD-30 of Heinrich Borgwaldt/Hamburg. A low packing density of for example, approximately 150 mg/cm$^3$, causes a more "pungent" flavored cigarette, whereas a higher range of for example 220 to 280 mg/cm$^3$ causes strand sorption to rise and through additional filter action the "pungent" flavor is reduced. This reduction can also cause other flavor impressions.

The air permeability of cigarette paper as expressed in CORESTA units is the amount of air in cubic centimeters which passes through one square centimeter of the paper in one minute at a constant pressure difference of 1.0 kilo pascal.

The cigarette paper air permeability of standard market cigarettes is 25 to 70 CORESTA units as determined by DIN/ISO 2965 (Deutsch Industrie Norm/International Standard Organization). Low CORESTA paper allows only a low smoldering capacity and a low ventilation and consequently only a limited thinning of smoke occurs through the cigarette paper. High CORESTA paper permits a high smouldering rate with high ventilation. In the cigarettes of the present invention, the cigarette paper air permeability is set to 3 to 20

CORESTA units which is below the standard market range of at least 25 CORESTA units.

In the cigarette of the present invention, fine titre cellulose acetate filters provided with standard hardnesses and without any flavor-changing additives are used.

The individual titre of the filter material of standard commercial cigarettes is approximately 2.5 to 3.5 denier. A lower individual titre, e.g., 1.3 denier results in a relatively high sorption and a relatively high retention on the filter and relatively high draw resistance, whereas correspondingly higher denier values with otherwise identical parameters lead to a lower sorption, lower retention, and lower draw resistance. Compared with the titre range of filters of standard commercial cigarettes (2.5 to 3.5 denier) the individual titre of the cigarettes of the present invention is lower, in the range of 1.3 to 2.5 denier.

The total titre which influences the absolute draw resistance of the cigarette, is generally between 32,000 and 40,000 denier in standard commercial cigarettes. The absolute sorption/retention or absolute draw-resistance is directly proportional to the total titre, whilst ignoring the crinkling index. The resulting filter draw resistance in the case of standard cigarettes is 50 to 70 daPa. A low draw resistance value does not greatly alter the flavor, however, a higher value provides a definite flavor change in the "mild" direction. The draw resistances of the low individual titre cigarettes of the present invention are 95 to 160 daPa.

The secondary air level, i.e., the ratio of secondary air to the main stream smoke, is between 18 and 50% in standard commercial cigarettes. Increasing the secondary air supply to approximately 75% produces a marked flavor change in the "super-mildness" direction. The secondary air supply of the cigarettes of the present invention is in a filter ventilation range of 20 to 45%, a medium range.

The final draw resistance of standard commercial filter cigarettes is in a range 80 to 120 daPa. Higher final draw resistances are considered by the consumer to be abnormal and not desired in standard mild cigarettes. The final draw resistance of 100 to 160 daPa chosen for the inventive cigarette is intentionally in the upper range, so as to influence the pollutant index.

In the ventilated filter cigarette of this invention made from natural Virginia tobacco having a high nicotine content there is a marked change in the flavor direction of the smoke from Virginia to American-blend. This change occurs by utilizing a special choice of filling tobacco packing density which is below the standard market range, a cigarette paper having an unconventionally low air permeability, and a filter having a non-standard, low individual titre and the total titre matched thereto producing a non-standard, high draw resistance.

A non-standard condensate/nicotine ratio of 5:1 to 9:1 is obtained in the main stream smoke of the cigarettes of the present invention. In addition, these cigarettes have a comparatively high smoke pH value of greater than 6, which despite a 10 mg maximum condensate value and a low pollutant index (less than 35), may explain the extremely high consumer-relevant degree of saturation, but not the "flavor inversion" from Virginia to American-blend flavor obtained.

The relevant tobacco parameters constituents including tobacco packing density, air permeability of the cigarette paper and individual titre, total titre and draw resistance of the cellulose acetate filter in conjunction with the final draw resistance may influence the flavor inversion. The natural Virginia tobaccos used, unlike most commercially available tobacco blends, have not undergone any chemothermal treatment, have a relatively high residual sugar content, a selected high nicotine content, and at the same time, a low nitrate and $NH_3$ content. Using a relatively low porosity cigarette paper with an air permeability of less than 20 CORESTA units in combination with a low filter ventilation level of approximately 20 to 45%, and the chosen blend of tobacco with a strand density matched to the tobacco choice and finish, an apparently optimum glow zone temperature is achieved. At this optimum temperature most of the decomposed aroma substances or their precursors are released or converted. The undesirable sensory factors released during incomplete combustion of the tobacco from nitrogen-containing organic substances, such as lower amines, aldehydes, alcohol acids or esters, contribute to the typical Virginia flavor, namely "pungency" or "acridness". These undesirable factors are held back by the unusually fine-titre monoacetate filter with a high retention capacity in an apparently specific manner, whilst the aroma substances and the desired tobacco constituents, such as nicotine and homologs are retained by the main stream smoke to provide the "volume" and/or "strength", "aroma" and flavors. The secondary stream of smoke of the inventive cigarette has a marked Virginia odor, but the main stream smoke of the same cigarette has a typical American-Blend flavor or taste.

EXAMPLE

Test cigarettes of pure Virginia tobacco without any flavor-modifying additives and without aroma substances, but with standard proportions of a humectant were manufactured. The tobacco weight of the strands produced in the strand format was 690 mg. The cigarette paper used had a permeability of 20 CORESTA units. The packing density of the filling tobacco was set to 220 mg/cm$^3$. The strand had a well packed filling level which gave a strand hardness value of 2.2 mm ET. The hardnesses of standard market cigarettes measured with the same hardness instrument were between 1.9 and 2.5 mm ET under normal climatic conditions.

The filter used was a monoacetate filter with a titre of 1.5 Y/46,000 SK denier. Its draw resistance for a length of 21 mm and a diameter of approximately 7.8 mm was approximately 118 daPa. The finished filter cigarette format was 7.90 mm in diameter and 84 mm in length. The secondary air level was 37% and the final draw resistance 130 daPa.

The cigarette smoked in accordance with DIN 10240 gave in 10 draws, 7.95 mg condensate and 1.0 mg nicotine, which corresponded to a condensate/nicotine ratio of approximately 8:1. The pH-value of the smoke was 6.4. This value is extraordinarily high in view of the typical smoke pH-value of a Virginia cigarette of 5.5 maximum.

Taste tests carried out showed the flavor of this cigarette to be a "typical American-Blend" with a "high degree of saturation" (corresponding to the aroma and enjoyment) and namely from the first draw. It was found that the undesirable factors such as "pungency" and "acridness" specific to Virginia tobacco did not occur.

Sensory comparison tests revealed that the cigarettes according to the invention were compared with strong American-Blend filter cigarettes with DIN values in the smoke of 15 mg condensate and 1 mg nicotine.

The pollutant index according to Herzfeld was approximately 31 and was calculated according to the following formula:

| Herzfeld Pollutant Index[1] | | | | Values According to Example | |
|---|---|---|---|---|---|
| Smoke condensate | (mg/cig.) | × | 3.333 | 7.95 mg | 26.50 |
| Smoke nicotine | (mg/cig.) | × | 50.00 | 1.00 mg | 50.00 |
| CO (in HSR) | (mg/cig.) | × | 4.17 | 9.98 mg | 41.62 |
| NO (in HSR) | (mg/cig.) | × | 156.25 | 0.030 mg | 5.74 |
| Sum | | × | 0.25 | | 124.06 |
| Pollutant index according to example | | | | | 31.02 |

[1]Munchener Medizinische Wochenschrift; 123 (23); 939–940, June 5, 1981

EXAMPLE 2

Comparison Test

Use was made of a tobacco strand from the same natural Virginia tobacco blend and with the same packing density as described for Example 1, as well as a cigarette paper with the same low air permeability of 20 CORESTA units, but with a conventional ventilated cellulose acetate filter having average individual and total titre values and a corresponding average draw resistance, with the consequent average filter retention, but with a comparatively high filter ventilation level, i.e., a high smoke thinning. This cigarette when smoked according to DIN 10240 gave comparable condensate values to the filter cigarette according to example 1. However, the taste of this cigarette was not a typical American-blend flavor. Its flavor was significantly that of Virginia tobacco, although full and aromatic, i.e., a standard Virginia cigarette.

In a further sensory comparison test, a filter as described for Example 1 was combined with a conventional Virginia strand. When smoked a marked Virginia flavor was obtained, but its flavor capacity was unsatisfactory and weak.

As to the determination of the following parameter:

a) The hardness/haptic range is measured by lowering a weight of 260 g onto the cigarette rod, whereby the depression is measured in mm ET (impression depth);

b) the condensate value in milligrams is measured with a smoking machine Model 302 of Filtrona (Filtrona Instruments Corporation, Richmond, USA) according to International Standard (ISO) 7210, 4387, 3308;

c) the air permeability of a paper as expressed in CORESTA units is the amount of air in cubic centimeters which passes through one square centimeter of the paper in one minute at a constant pressure difference of 1.0 kilopascal.

Having described the invention above, various modifications of the techniques, procedures, material and equipment will be apparent to those in the art. It is intended that all such variations within the scope and spirit of the appended claims be embraced thereby.

We claim:

1. A ventilated filter cigarette comprising:

a filling tobacco consisting of substantially pure Virginia tobacco having a nicotine content of approximately 2 to 3% by dry weight;

a packing density of the filling tobacco of approximately 150 to 250 mg/cm$^3$;

a cigarette paper having an air permeability of less than 25 CORESTA units; and a fine-titre cellulose acetate filter.

2. The ventilated cigarette of claim 1 wherein the cigarette rod has a characteristic hardness/haptic range of approximately 1.9 to 2.5 mm ET.

3. The ventilated cigarette of claim 1 wherein said fine titre cellulose acetate filter has a characteristic total titre of approximately 40,000 to 55,000 denier.

4. The ventilated cigarette of claim 1 wherein said fine titre cellulose acetate filter has an individual titre of approximately 1.3 to 2.5 denier.

5. The ventilated cigarette of claim 1 wherein the Virginia tobacco is in the natural state.

6. A ventilated filter cigarette comprising:

a filling tobacco consisting of substantially pure Virginia tobacco, having a nicotine content of approximately 2 to 3% by dry weight;

a packing density of the filling tobacco of approximately 150 to 250 mg/cm$^3$;

a cigarette paper having an air permeability of less than 25 CORESTA units;

a fine-titre cellulose acetate filter; and a final draw resistance of 100 to 160 daPa.

7. The ventilated filter cigarette of claim 6 wherein the cigarette rod has a characteristic hardness/haptic range of approximately 1.9 to 2.5 mm ET.

8. The ventilated filter cigarette of claim 6 wherein said fine titre cellulose acetate filter has a characteristic total titre of approximately 40,000 to 55,000 denier.

9. The ventilated filter cigarette of claim 6 wherein said filling tobacco is Virginia tobacco is in the natural state.

10. The ventilated filter cigarette of claim 6 wherein the secondary air supply is set to a filter ventilation level of approximately 20 to 45%.

11. The ventilated filter cigarette of claim 6 wherein cigarette's main stream smoke has a condensate/nicotine ratio of approximately 5:1 to 9:1 in the case of a condensate value of max. 10 mg.

12. The ventilated filter cigarette of claim 11 wherein said main stream smoke has a pH value greater than 6.0.

13. The ventilated filter cigarette of claim 12 having a Herzfeld pollutant index of less than 35.

14. A ventilated filter cigarette comprising:

a filling tobacco of substantially natural Virginia tobacco without any flavor modifying additive having a nicotine content of approximately 2 to 3.5% by weight and a packing density of approximately 150 to 250 mg/cm$^3$;

a cigarette paper having an air permeability of approximately 3 to 20 CORESTA units and a rod hardness/haptic range of approximately 1.9 to 2.5 mm ET.;

a fine-titre filter comprising standard hardness and without flavor-modifying additives having an individual titre of approximately 1.3 to 2.5 denier and a total titre of approximately 40,000 to 55,000 denier and a secondary air supply set to a filter ventilation level of approximately 20 to 45%; and a final draw resistance of approximately 100 to 160 daPa.

15. The ventilated filter cigarette of claim 6 having a fine-titre cellulose acetate filter with a draw resistance of 95 to 160 daPa in the case of a filter length of 21 mm and a diameter of 7.8 mm.

16. The ventilated filter cigarette of claim 14 having a fine-titre cellulose acetate filter with a draw resistance of 95 to 160 daPa in the case of a filter length of 21 mm and a diameter of 7.8 mm.

17. A ventilated filter cigarette containing exclusively Virginia tobacco, whose main stream smoke has a condensate/nicotine ratio of approximately 5:1 to 9:1, a condensate value according to DIN 10240 of 10 mg maximum, a pH value of at least 6.0, and a Herzfeld pollutant index of less than 35, comprising:

a filling tobacco consisting of substantially pure Virginia tobacco, left in the natural state and without any flavor-modifying additives, having a nicotine content of approximately 2 to 3.5% by dry weight;

a packing density of the filling tobacco of approximately 150 to 250 mg/cm$^3$;

a cigarette paper having an air permeability of less than 25 CORESTA units, wherein the combination of the filling tobacco, packing density, and air permeability is such that a finished strand has a characteristic standard hardness/haptic range of 1.9 to 2.5 mm ET;

a fine-titre cellulose acetate filter having standard hardeners and without flavor modifying additives, and having an individual titre of 1.3 to 2.5 denier and a total titre matched thereto of approximately 40,000 to 55,000 denier, and a secondary air supply set to a filter ventilation level of approximately 20 to 45%; and a final draw resistance of the filter cigarette of approximately 100 to 160 daPa.

* * * * *